United States Patent [19]

Kawasumi et al.

[11] 4,314,181

[45] Feb. 2, 1982

[54] ARC DISCHARGE LAMP STARTING DEVICE

[76] Inventors: Kenichi Kawasumi, 7-4-2, Kabemachi, Ohme-shi, Tokyo; Kenji Narikiyo, 2196-560, Hirai, Hinodemachi, Nishitama-gun, Tokyo, both of Japan

[21] Appl. No.: 152,541

[22] Filed: May 23, 1980

[30] Foreign Application Priority Data

Jun. 18, 1979 [JP] Japan ..... 54-75717

[51] Int. Cl.[3] ..... H05B 41/18; H01J 61/56

[52] U.S. Cl. ..... 315/289; 315/47; 315/73; 315/DIG. 2; 337/26

[58] Field of Search ..... 315/47, 73, 74, 103, 315/189, 190, 362, DIG. 2; 337/26, 27

[56] References Cited

U.S. PATENT DOCUMENTS 3,740,686 6/1973 Jarrige et al. ..... 315/290 X
4,135,114 1/1979 Narikiyo ..... 315/289 X

FOREIGN PATENT DOCUMENTS 543385 1/1979 Japan ..... 315/290

*Primary Examiner*—Eugene La Roche
*Attorney, Agent, or Firm*—Kenyon & Kenyon

[57] ABSTRACT

Disclosed is an arc discharge lamp starting device which comprises a starting aid circuit connected in parallel to an arc tube and disposed within an outer envelope. This starting aid circuit comprises a thermal switch, a heater and a resistor. This thermal switch includes contact rods having a high melting point and a small work function and a bimetal plate.

In this arc discharge lamp starting device, since the time of duration of the chattering phenomenon caused between the contact rods is very long, the arc discharge lamp can be started assuredly by this starting device.

3 Claims, 6 Drawing Figures

ARC DISCHARGE LAMP STARTING DEVICE

BACKGROUND OF THE INVENTION (1) Field of the Invention

The present invention relates to an improved starting device for starting a high pressure metal vapor discharge lamp, particularly a metal halide lamp.

(2) Description of the Prior Art

A metal halide lamp or high pressure sodium lamp cannot be started by a 200 V commercial power source with a ballast for a conventional mercury lamp because the starting voltage of the metal halide lamp or high pressure sodium lamp is much higher than that of the mercury lamp. Accordingly, improvements have been made on the lamp per se or starting devices, and at the present, a high pressure metal vapor discharge lamp of the low starting voltage type, which can be started by the ballast for the mercury lamp, is put into practical use.

An instance of the starting device enabling starting of a high pressure metal vapor discharge lamp by a 200 V commercial power source with a ballast for a conventional mercury lamp is illustrated in FIG. 1. As is seen from FIG. 1, in this starting device, a starting aid circuit 12 comprising, connected in series, an anti-snap thermal switch 4 which is closed at room temperature and opened at a high temperature, a heater 5 for opening the thermal switch 4 and a resistor 6 for controlling an electric current flowing in the heater 5 is connected to an arc tube 3 in parallel thereto and communicated with a 200 V commercial power source 1 through an inductive ballast 2 for a mercury lamp. The starting aid circuit 12 and arc tube 3 are arranged in an outer envelope 7. When a power is applied from the power source 1, an electric current flows in the starting aid circuit 12 and the heater 5 generates the heat. The thermal switch 4 heated by the heater 5 is opened to cut the electric current flowing in the heater 5. Accordingly, the thermal switch 4 is cooled and is then closed again. As is well known, when this thermal switch 4 is opened, a single high voltage pulse is generated between both the terminals of the inductive ballast 2. However, a high pressure metal vapor discharge lamp, especially a metal halide lamp, can hardly be started by this single high voltage pulse. When the thermal switch 5 is cooled and closed, a great number of high frequency pulses are overlapped to the power source voltage by the chattering phenomenon of the thermal switch 4, as shown in FIG. 3, and this state is retained during a considerable period. The time t shown in FIG. 3 indicates the duration time of such high frequency pulses, and this time t is ordinarily in the range of from 0.01 second to several seconds. By this duration of high frequency pulses, the metal halide lamp can be started at a relatively low pulse voltage ($V_p$).

FIGS. 2-A and 2-B illustrate one embodiment of the structure of the thermal switch 4 in FIG. 4. FIG. 2-A is a front view and FIG. 2-B is a side view. The thermal switch 4 comprises contact rods 8 and 8' composed of a high-melting-point metal, a bimetal plate 9, supporters 10 and 10' and an insulator 11 for fixing the supporters 10 and 10'. Pure tungsten rods are used as the contact rods 8 and 8', and the supporters 10 and 10' and the insulator 11 comprise, for example, a combination of Mo wires and Mo glass or a combination of Kovar and Kovar glass.

The most important characteristics of this starting device are the time t of duration of high frequency pulses (see FIG. 3) and the amplitude $V_p$ of high frequency pulses (see FIG. 3), and the reliability of the starting performance is influenced by values of these characteristics. More specifically, the longer is the duration time t or the larger is the high frequency pulse amplitude $V_p$, the more improved is the reliability of the starting performance of the starting device. However, if the high frequency pulse amplitude $V_p$ is too large, reduction of the insulating ability of the ballast, a screw base or other lighting equipment is accelerated. Accordingly, it is necessary to maintain the high frequency pulse amplitude $V_p$ at a level not exceeding 5 KV. Therefore, it has been desired to prolong the duration time t of high frequency pulses assuredly by some means or other in order to improve the starting characteristic.

SUMMARY OF THE INVENTION

It is therefore a primary object of the present invention to provide a novel starting device in which the duration time of high frequency pulses can be assuredly prolonged so as to improve the reliability of the starting performance of the starting device.

In the present invention, the above object is attained by a starting device having the above-mentioned structure, which is characterized in that contact rods of the thermal switch are composed of a high-melting-point metal material having a work function not exceeding 3.5 eV.

The present invention has been completed based on the following findings.

When the thermal switch is opened and is then cooled, the contact rods are going to be closed. At this point, namely as the contact rods are brought close to each other and the distance between the contact rods is narrowed, the field strength between the contact rods is remarkably increased. The lower is the work function determined by the material of the contact rods, the more readily taken out are electrons by this increased field strength. As the result, discharge takes place between the contact rods before they fall in contact with each other. The bimetal plate is heated by this discharge to separate the contact rods from each other and stop the discharge, and then, the contact rods are brought close to each other again. Since this phenomenon is repeated in a very narrow area between the contact rods, high frequency discharge is repeated. It is construed that this repetion of high frequency discharge may be a cause of lasting generation of high frequency pulses. Of course, in order to generate high frequency pulses continuously, it is indispensable that melt adhesion of the contact rods to each other should not be caused by discharge. Accordingly, it is indispensable to use a high-melting-point material such as tungsten for the contact rods.

When contact rods are made from a material having a large work function, even if the contact rods are brought close to each other, electrons are hardly discharged, and therefore, complete contact is attained between the contact rods. At this point, melt adhesion is caused between the surfaces of the two contact rods by an electric current. Then, the bimetal plate is heated, and the two contact rods are separated from each other in a moment by the energy generated by heating of the bimetal plate. At this point of separation, a single pulse is generated. Since the bimetal plate is cooled again, the contact rods are brought close to each other again. In short, only single pulses are generated repeatedly, and therefore, the duration time of the pulse is very short.

When the above-mentioned characteristic structure of the present invention is adopted, a duration time of high frequency pulses necessary for starting a high pressure metal vapor discharge lamp can be guaranteed with certainty, and the reliability of the starting performance of the starting device can be remarkably improved.

DETAILED DESCRIPTION OF THE PREFERRED EMBODIMENTS

Figure 4:
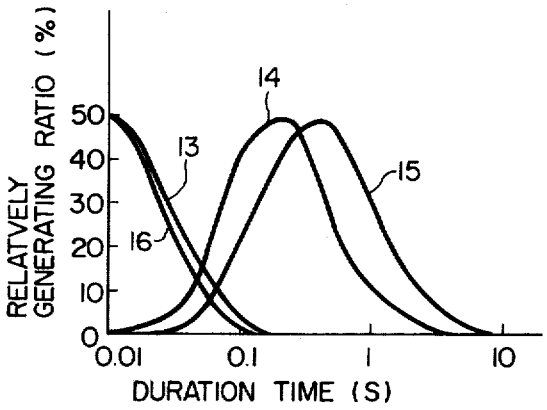
FIG. 4 is a duration time distribution view indicating that pulse duration times differ among contact-constituting materials.

In FIG. 4, the high frequency pulse duration time (seconds) is plotted on the abscissa on a logarithmic scale and the relatively generating ratio (%) is plotted on the ordinate, to show distributions obtained in case of various metal materials of contact rods. The relatively generating ratio is determined in the following manner.

Figure 1:
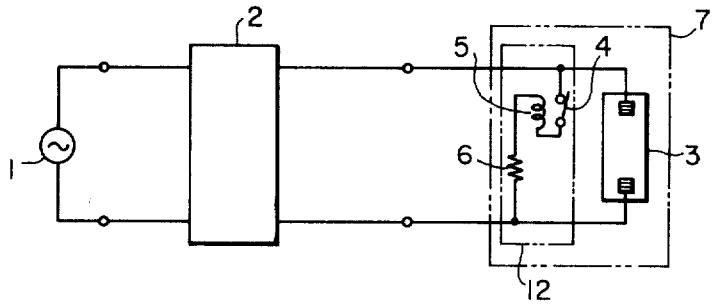
FIG. 1 PRIOR ART
FIG. 1 is a circuit diagram of the starting device used in the present invention.
Figure 2A:
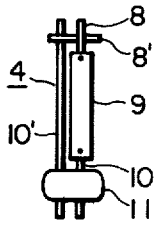
FIG. 2A PRIOR ART
FIG. 2-A and FIG. 2-B are views showing the structure of the thermal switch used in the starting device shown in FIG. 1.
Figure 2B:
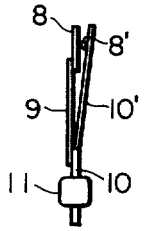
FIG. 2B PRIOR ART
Figure 3:
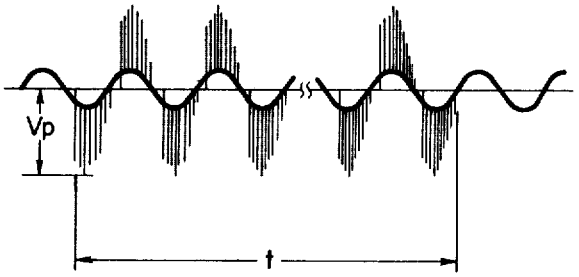
FIG. 3 PRIOR ART
FIG. 3 is a view showing the wave form of the pulse voltage applied to the arc tube by the circuit shown in FIG. 1.

The starting test is repeated 200 times (the total test times) on one sample. Duration times of high frequency pulses are divided by units of 1 second if the duration time is longer than 1 second, by units of 0.1 second if the duration time is not shorter than 0.1 second but shorter than 1 second and by units of 0.01 second if the duration time is shorter than 0.01 second. The appearance frequency (times) of each duration time is determined and the percentage of the appearance frequency (times) to the total test times is calculated. Each distribution graph is drawn by connecting the tops of bars of respective duration times in a bar graph showing the above percentage values. The starting device used in the starting test is one shown in FIG. 1, which has the thermal switch 4 shown in FIGS. 2-A and 2-B. The resistance value of the resistor 6 is 300Ω, the voltage of the commercial power source 1 is 200 V and the diameter of the contact rods 8 and 8' is 1 mm. A metal halide lamp is started by this starting device.

Referring to FIG. 4, curve 13 shows the distribution obtained when pure tungsten rods (having a work function of 4.5 eV) are used as the contact rods. The pulse duration time is about 0.1 second at longest and the relatively generating ratio of this longest duration time is very low. The pulse duration time having a highest relatively generating ratio is about 0.01 second. Curve 16 shows the distribution obtained when molybdenum rods (having a work function of 4.37 eV) are used as the contact rods. The pulse duration time distribution curve is substantially the same as the curve 13 obtained in case of pure tungsten.

Curve 14 shows the distribution obtained when tungsten containing 1% by weight of zirconium oxide (having a work function of 3.14 eV) is used as the contact rod material. The pulse duration time is about 3 seconds at longest and the pulse duration time having a highest relatively generating ratio is about 0.2 second. This value is about 20 times as high as the values obtained in case of pure tungsten and molybdenum, which are shown in the curves 13 and 16.

Curve 15 shows the distribution obtained when tungsten containing 2% by weight of thorium oxide (having a work function of 2.6 eV) is used as the contact rod material. The pulse duration time is about 6 seconds at longest and the pulse duration time having a highest relatively generating ratio is about 0.4 second. This value is about 2 times the value of zirconium oxide-containing tungsten shown in curve 14 and about 40 times the values of pure tungsten and molybdenum shown in curves 13 and 16.

The following two experiments are carried out on the thorium oxide-containing tungsten rods. In one experiment, the content of thorium oxide is increased to 4% by weight. In the other experiment, the diameters of rods are arranged to 0.8 mm, 1.2 mm and 1.4 mm, in addition to 1 mm. The test is conducted on each rod diameter. Results of these two experiments are plotted on the coordinates of FIG. 4. Results obtained in each case are not substantially different from the results obtained when the diameter is 1 mm and tungsten containing 2% by weight of thorium oxide is used, which are shown in curve 15.

In case of a high pressure metal vapor discharge lamp, especially a metal halide lamp, it has been confirmed from results of various experiments that if the pulse duration time is shorter than 0.1 second, the starting characteristic is abruptly degraded and this degradation is not prevented even by increasing the amplitude of the pulse. Therefore, it is indispensable that the pulse duration time should be at least 0.1 second.

When results shown in FIG. 4 are examined while taking the above fact into account, it is seen that when contact rods of pure tungsten and molybdenum shown in curves 13 and 16 are used, the probability of starting a metal halide lamp is very low.

Figure 5:
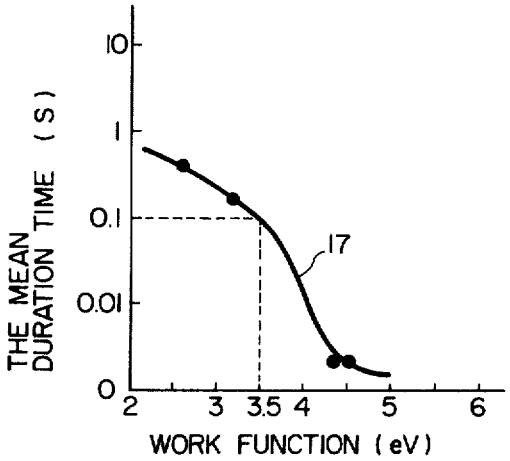
FIG. 5 is a graph illustrating the relation between the work function of the contact-constituting material and the pulse duration time.

In FIG. 5, the work function (eV) of the contact rod material is plotted on the abscissa and the mean duration time (second) of high frequency pulses is plotted on the ordinate on a logarithmic scale. From curve 17 of FIG. 5, it is seen that there is a very close relation between the work function of the contact rod material and the pulse duration time. Also from curve 17, it is seen that in order to obtain a pulse duration time of at least 0.1 second, which is necessary for starting a metal halide lamp, it is indispensable that a contact rod material having a work function not exceeding 3.5 eV should be used.

Incidentally, as pointed out hereinbefore, it is indispensable that the contact rod material should have such a property that melt adhesion of contact rods is not caused by chattering phenomenon of the contact rods.

In the above-mentioned experiments, thorium oxide-containing tungsten and zirconium oxide-containing tungsten are mentioned as preferred contact rod materials. However, preferred materials are not limited to these materials, but as will readily be understood from FIG. 5, any of metal materials having a work function not exceeding 3.5 eV and such a high melting point as that of tungsten, can be preferably used.

In a starting device having contact rods composed of the above-mentioned specific contact rod material of the present invention, the pulse duration time can be prolonged assuredly, and the reliability of the starting performance of the starting device can be remarkably improved.

What is claimed is:

1. An arc discharge lamp starting device for connecting an arc discharge lamp to a power source through an inductive ballast, which comprises a starting aid circuit including, connected in series, a thermal switch having contact rods which are closed at room temperature and opened at a high temperature, a heater for controlling opening and closing of the thermal switch and a resistor for controlling an electric current flowing in the heater, said starting aid circuit being connected in parallel to an arc tube, wherein said contact rods of the thermal switch are composed of a high-melting-point metal material having a work function not exceeding 3.5 eV.

2. An arc discharge lamp starting device as set forth in claim 1 wherein said metal material is thorium oxide-containing tungsten.

3. An arc discharge lamp starting device as set forth in claim 1 wherein said metal material is zirconium oxide-containing tungsten.

* * * * *